US008348483B2

(12) United States Patent
Lin

(10) Patent No.: US 8,348,483 B2
(45) Date of Patent: Jan. 8, 2013

(54) PORTABLE ILLUMINATION DEVICE

(76) Inventor: Hang-John Lin, Taichung (TW)

( * ) Notice: Subject to any disclaimer, the term of this patent is extended or adjusted under 35 U.S.C. 154(b) by 0 days.

(21) Appl. No.: 13/102,774

(22) Filed: May 6, 2011

(65) Prior Publication Data

US 2012/0281421 A1 Nov. 8, 2012

(51) Int. Cl.
*F21S 9/02* (2006.01)

(52) U.S. Cl. ..... 362/427; 362/285; 362/269

(58) Field of Classification Search ..... 362/269, 362/285, 288, 427
See application file for complete search history.

(56) References Cited

U.S. PATENT DOCUMENTS

2011/0140640 A1* 6/2011 Lu et al. ..... 362/427
2011/0141737 A1* 6/2011 Gu et al. ..... 362/249.1

* cited by examiner

*Primary Examiner* — David V Bruce

(57) ABSTRACT

A portable illumination device includes a base part, a cover, and an illumination unit, wherein the cover is pivotably connected to an end of the base part by a first pivot unit on the cover. The cover includes an opening and the illumination unit is accommodated in the opening. The illumination unit has a board and multiple illumination members on the board. The board is pivotable relative to the cover by a second pivot unit connected therebetween. The second pivot unit is connected to a third pivot unit which allows the illumination unit to be rotated when in use. The base part, the cover and the illumination unit can be folded to a compact body for convenience of carried.

5 Claims, 10 Drawing Sheets

PORTABLE ILLUMINATION DEVICE

FIELD OF THE INVENTION

The present invention relates to an illumination device, and more particularly, to a portable illumination device which can be used in different angles.

BACKGROUND OF THE INVENTION

The laptops are portable and light in weight so that they are welcomed and used in different ways. When using the laptops, extra illumination devices are needed and one of the illumination devices known to applicant includes a light source which is kept at a first position and a second position, when the light source is positioned at the first position, the light source illuminates the keyboard, and when the light source is positioned at the second position, the light source illuminates the space where the user is located.

The illumination device is installed in the laptop and is moved with the laptop. The price of the laptop with the illumination device is high and restricts its competition in the market keyboard. When the illumination device is damaged, the users are difficult to fix it because the illumination device is located in the laptop which is complicated and sophisticated. Therefore, an extra and portable illumination device is needed to satisfy the users in every situation.

The present invention intends to provide a portable illumination device which is portable and easily adjusted the angles of the light.

SUMMARY OF THE INVENTION

The present invention relates to an illumination device and comprises a base part having a switch connected to one side thereof and a first recess is defined in a top of the base part. The base part has a first base at one end thereof. A cover is pivotably connected to the base part and has an opening. The cover has a first pivot unit on a first end thereof and pivotably connected to the first base so that the cover is pivotable about the first base and relative to the base part. A second pivot unit is connected to a second end of the cover and has a support member, a pivot and two second bases. The pivot is connected to the support member and two ends of the pivot are pivotably connected to the two second bases. The second pivot unit is pivotable relative to the cover. An illumination unit is located within the opening of the cover and has an illumination member and a third pivot unit. The illumination member is connected to a board which is sized to be accommodated in the opening and the illumination member is sized to be received in the first recess. The board is pivotably connected to the third pivot unit which is rotatably connected to a third base which is fixed to the pivot of the second pivot unit. The board and the support member are located on the same surface and adjacent to each other when the cover is covered on the base part. The illumination unit is pivoted about the second pivot unit and positioned at different angles relative to the cover. The illumination unit is rotated about the third pivot unit so as to be position at different angles.

The base part and the cover are rectangular members and a light bulb is connected to an end of the first base. A USB connector is connected to front end of the cover. The base part has a battery reception hole defined in an underside thereof. Two recessed areas are defined in the base part and the first base is located between the two recessed areas so that the first pivot unit is pivotably located in the recessed areas.

The primary object of the present invention is to provide a portable illumination device which is compact and easily carried and stored in pockets.

The second object of the present invention is to provide a portable illumination device which is pivoted about three different axes wherein the cover is pivoted relative to the base part, the illumination unit is pivoted about the second pivot unit to adjust its position, and the light assembly of the illumination unit is rotated about the third pivot unit to illuminate desired position.

The third object of the present invention is to provide a portable illumination device wherein the user can hold the base part and the cover to use the light bulb as a flashlight.

The fourth object of the present invention is to provide a portable illumination device which has a USB connector and can be easily connected to a personal computer and a laptop.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
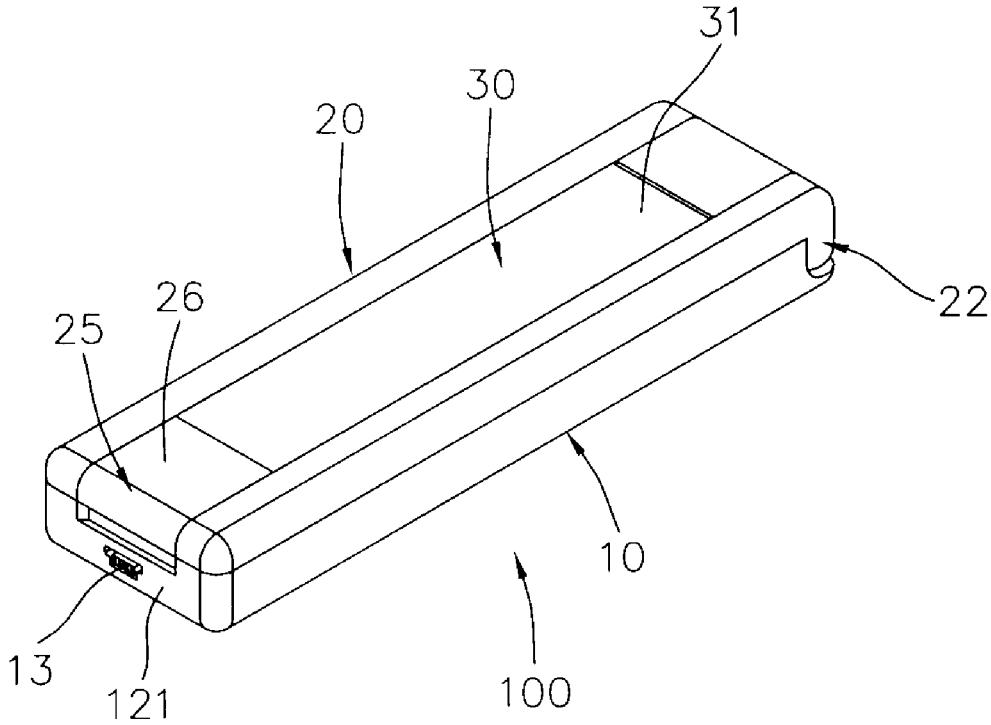
FIG. 1 shows that the portable illumination device is folded into a compact body.

Referring to FIGS. 1 to 4, the portable illumination device 100 of the present invention comprises a base part 10, a cover 20 pivotably connected to the base part 10 by a first pivot unit 22, and an illumination unit 30 pivotably connected to the cover 20 by a second pivot unit 25. The base part 10 and the cover 20 are rectangular members. The base part 10 has a first base 24 at one end thereof. The illumination unit 30 can be accommodated within the cover 20 and the outside of the combination is smooth. Both of the base part 10 and the cover 20 are rectangular members.

A switch 16 is connected to one side thereof and a USB connector 13 is connected to front end 121 of the cover 12 so that the portable illumination device 100 is conveniently connected with a personal computer and a laptop. The switch 16 controls operation of the illumination unit 30 and may have multiple functions to control the illumination unit 30. The base part 10 has a battery reception hole 15 defined in an underside thereof for receiving batteries therein which can be any known batteries. Two recessed areas 14 are defined in the base part 10.

A first recess 11 is defined in the top of the base part 10 and a second recess 111 is defined in the top of the base part 10 and communicates with the first recess 11. The second recess 111 is located close to the front end 121 of the base part 10 and perpendicular to the first recess 11 so as to form a T-shaped recess.

Figure 3:
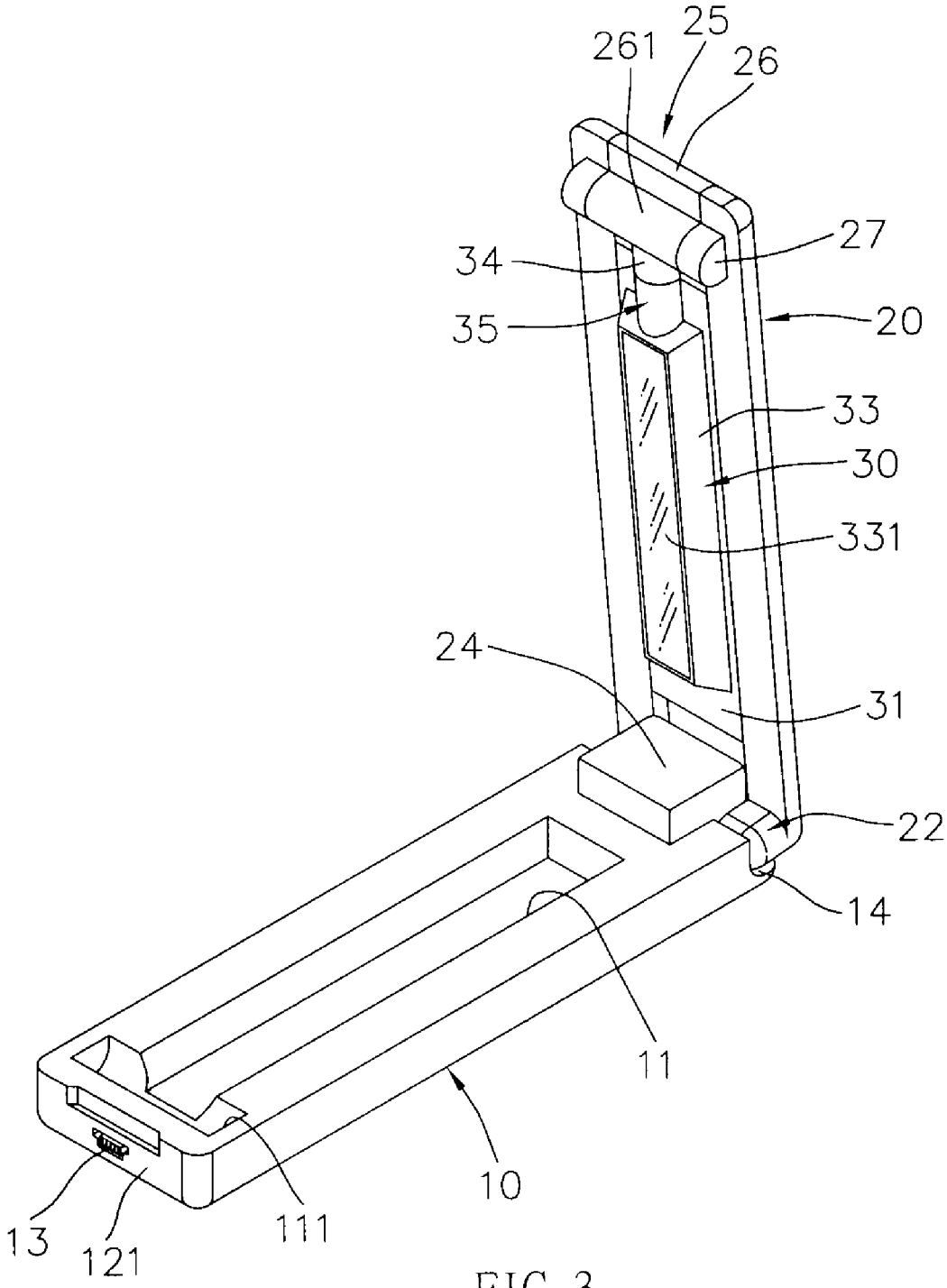
FIG. 3 is a perspective view to show that the cover of the portable illumination device of the present invention is pivoted relative to the base part.
Figure 4:
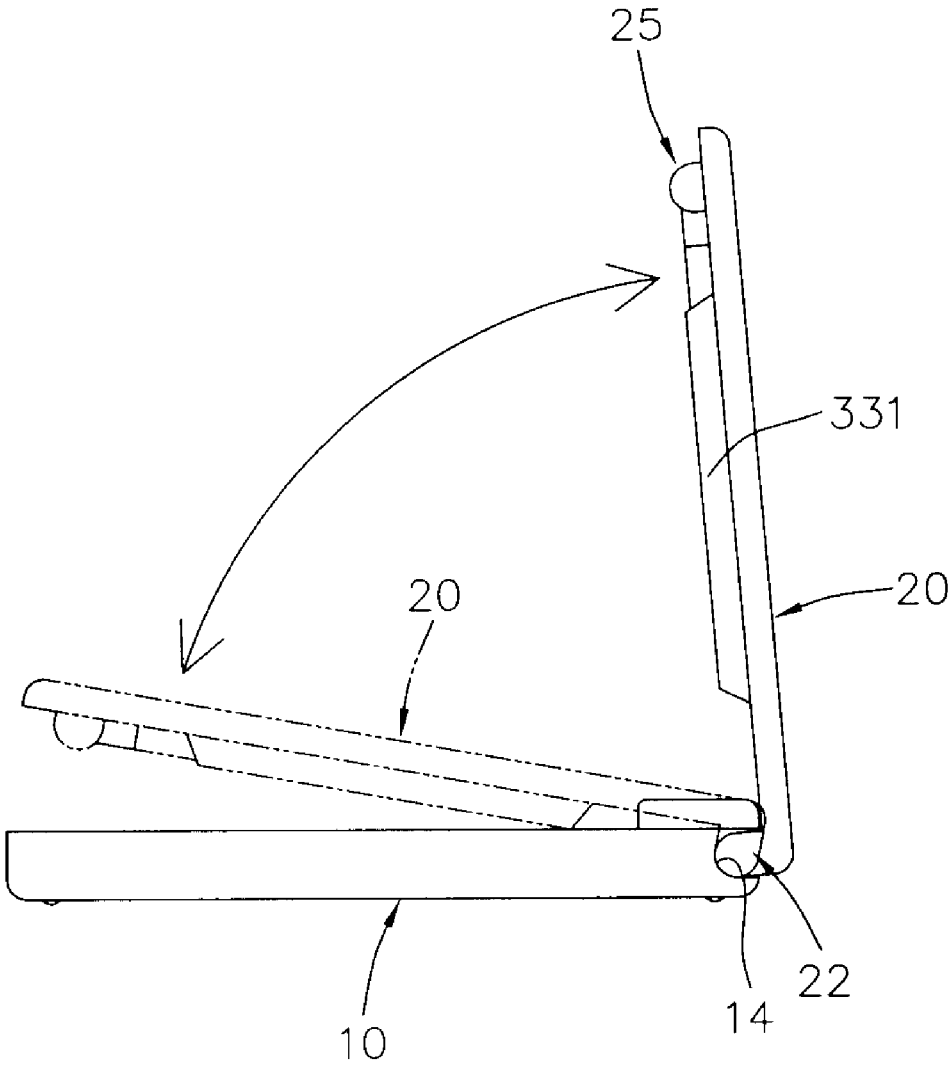
FIG. 4 is a side view to show that the cover of the portable illumination device of the present invention is pivoted relative to the base part.
Figure 5:
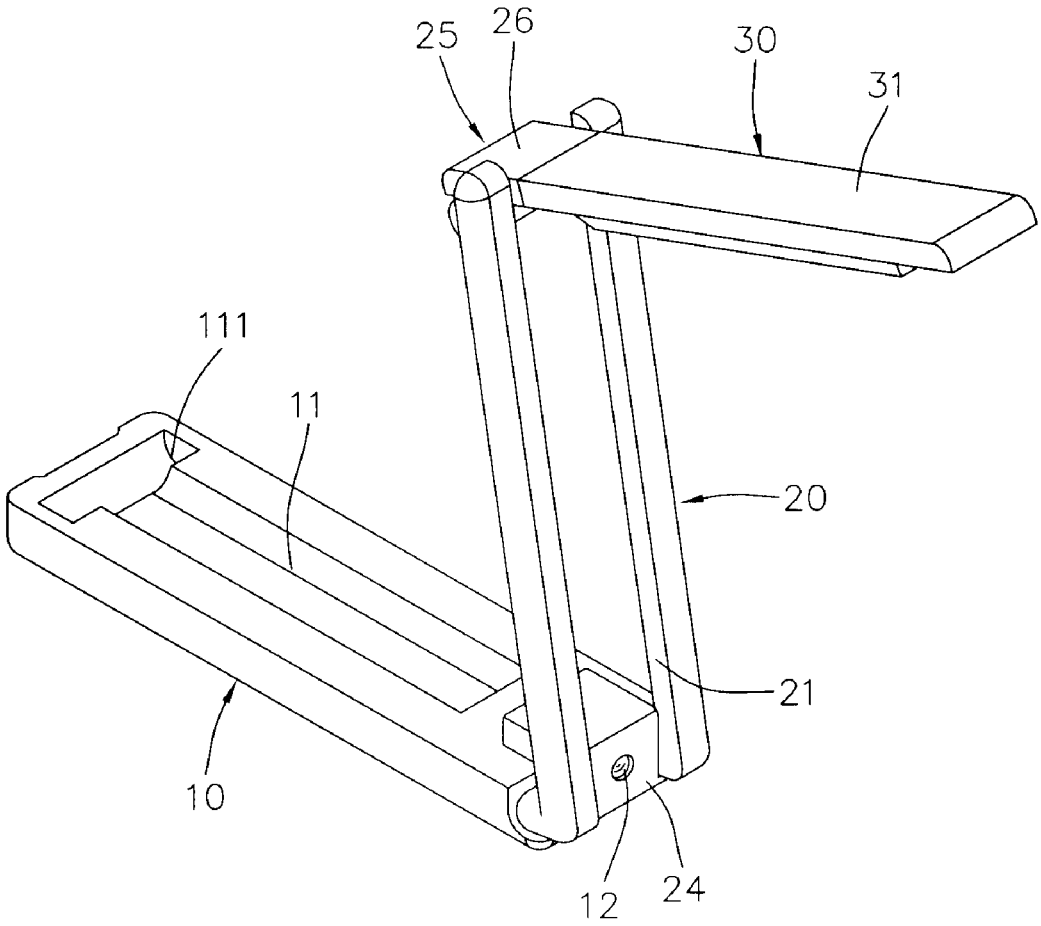
FIG. 5 shows that the illumination unit is pivoted relative to the cover of the portable illumination device of the present invention.

As shown in FIGS. 3 to 5, the cover 20 is pivotably connected to the base part 10 and has an opening 21. The cover 20 has a first pivot unit 22 on a first end thereof and pivotably connected to the first base 24 so that the cover 20 is pivotable about the first base 24 and relative to the base part 10. The first base 24 protrudes from the base part 10 and is located between the two recessed areas 14 so that the first pivot unit 22 is pivotably located in the recessed areas 14. A light bulb 12 is connected to an end of the first base 24. A second pivot unit 25 is connected to a second end of the cover 20 and has a support member 26, a pivot 261 and two second bases 27. The pivot 261 is connected to the support member 26 and two ends of the pivot 261 are pivotably connected to the two second bases 27. The two second bases 27 protrude from the cover 20 and are sized to be accommodated in the second recess 111. The second pivot unit 25 is pivotable relative to the cover 20. When the cover 20 is covered on the base part 10, the second pivot unit 25 and the second base 27 are accommodated in the second recess 111, and the support member 26 is matched to the top face of the base 10.

The illumination unit 30 is located within the opening 21 of the cover 20 and has an illumination member 33 and a third pivot unit 35 to which the cover 20 is connected. The illumination member 33 is connected to a board 31 which is sized to be accommodated in the opening 21 and the illumination member 33 is sized to be received in the first recess 11. The board 31 is pivotably connected to the third pivot unit 35 which is rotatably connected to a third base 34 which is fixed to the pivot 261 of the second pivot unit 25. The board 31 and the support member 26 are located on the same surface and adjacent to each other when the cover 20 is covered on the base part 10. The illumination unit 30 is pivoted about the second pivot unit 25 and positioned at different angles relative to the cover 20, and the illumination unit 30 can also rotated about the third pivot unit 35 so as to be position at different angles. The first base 24 protrudes from the base part 10 and the board 31 has a hole which is located corresponding to the first base 24 so that when the cover 20 is covered to the base part 10, the first base 24 is located within the hole of the board 31.

Figure 7:
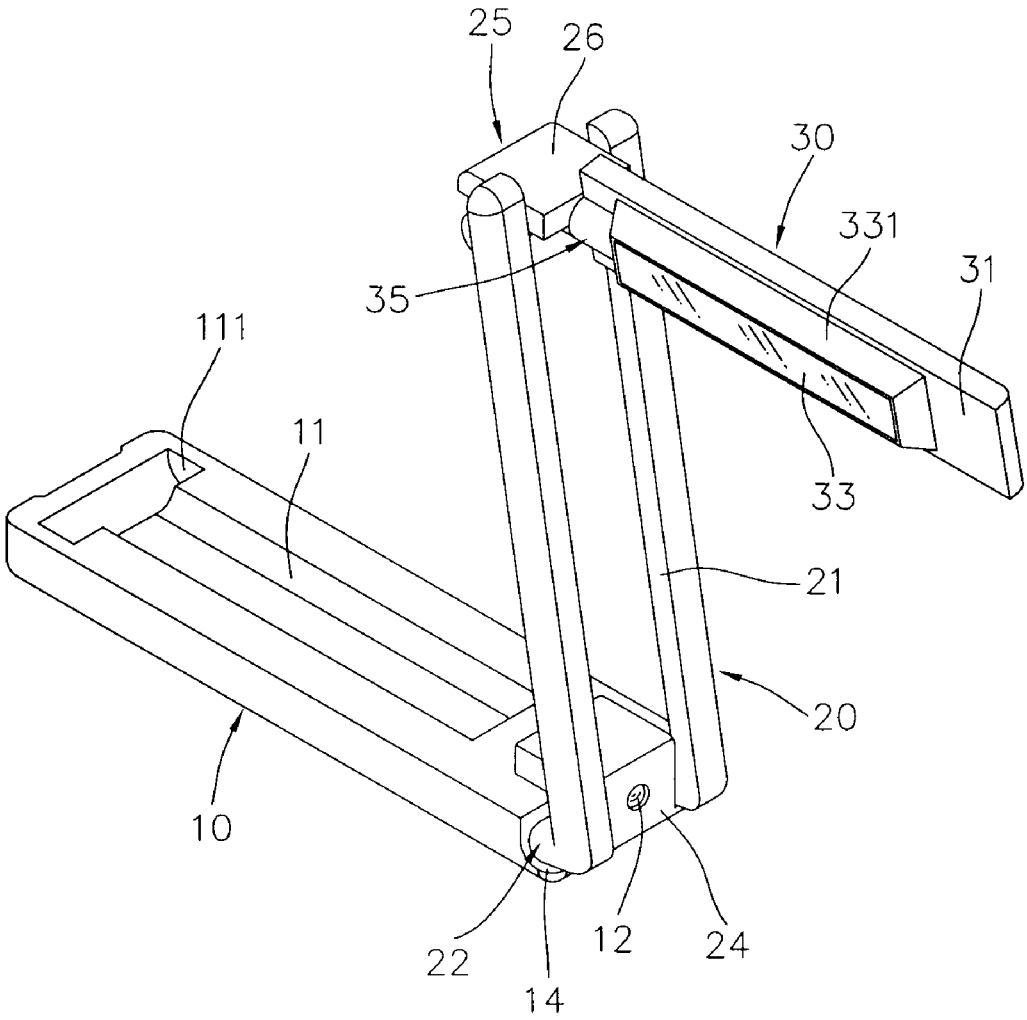
FIG. 7 shows that the illumination unit is rotated relative to the cover.
Figure 8:
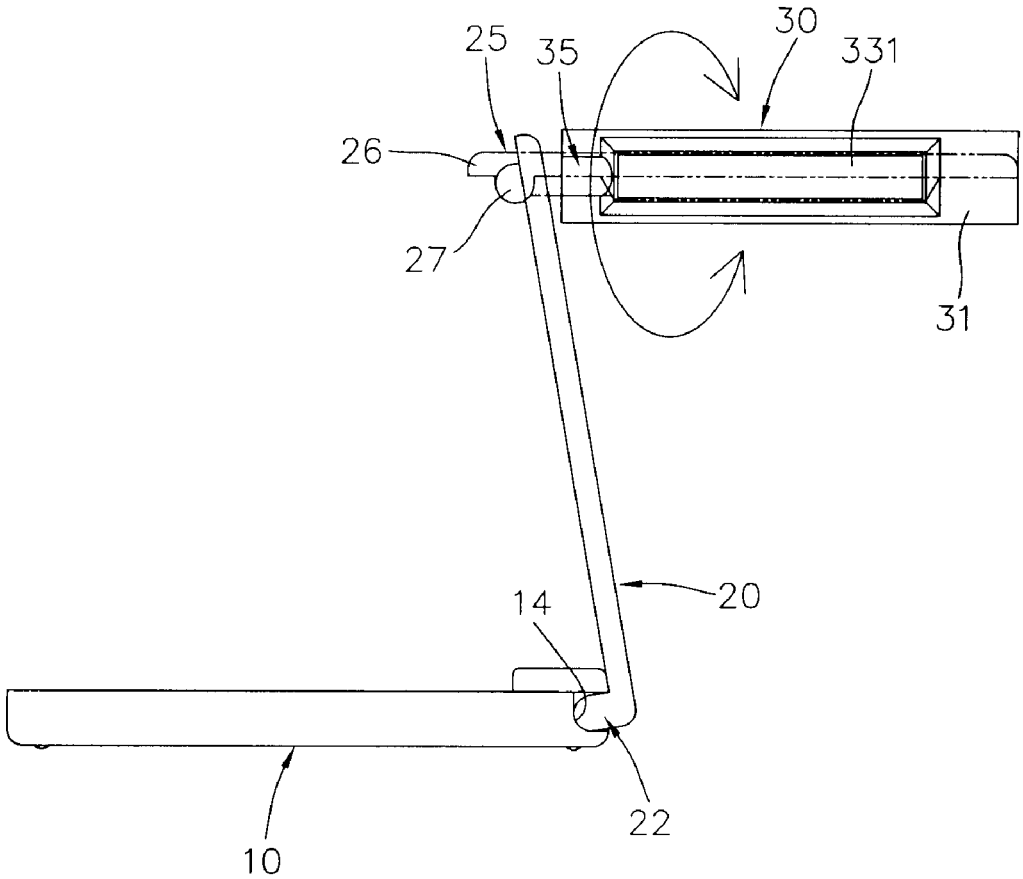
FIG. 8 is a side view to show that the illumination unit is rotated relative to the cover.
Figure 9:
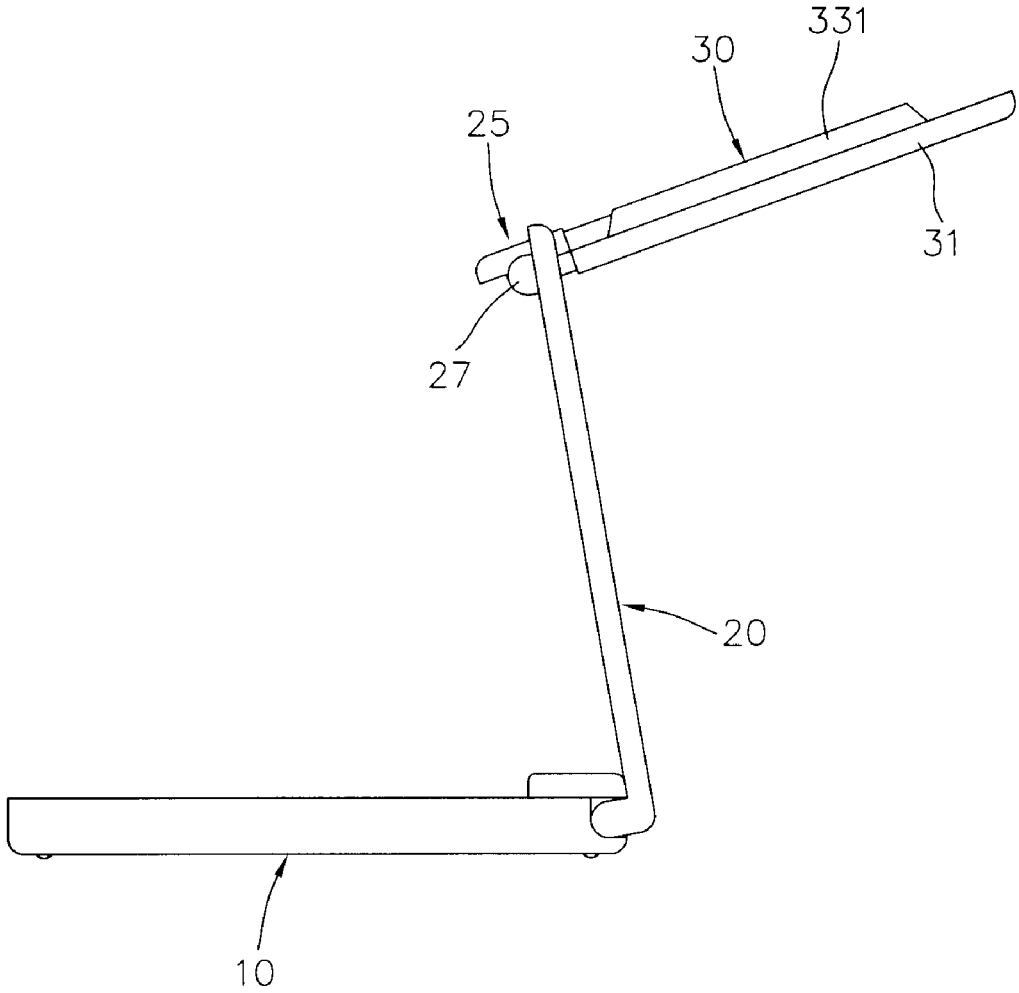
FIG. 9 is a side view to show another position of the illumination unit relative to the cover.
Figure 10:
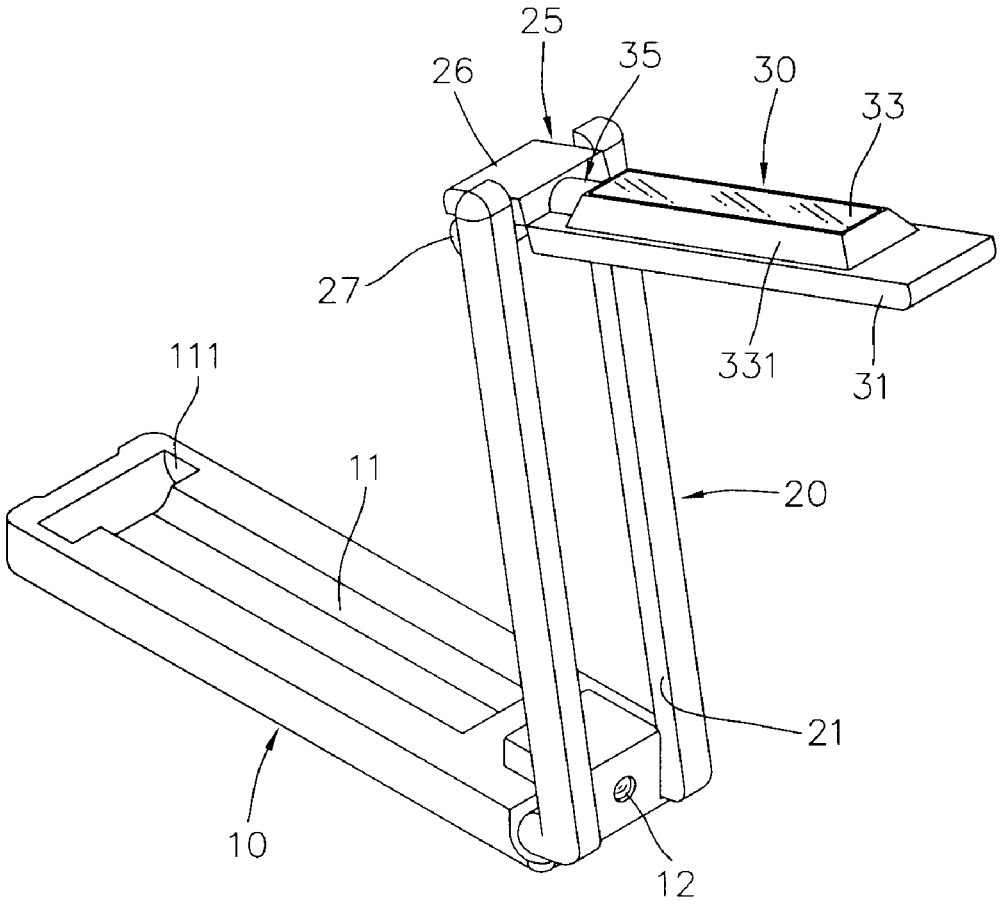
FIG. 10 is the perspective view of the status in FIG. 9.

As shown in FIGS. 5 and 7, the illumination unit 30 is pivoted about the second pivot unit 25 to allow the illumination unit 30 to rotate 90 or 180 degrees.

Figure 2:
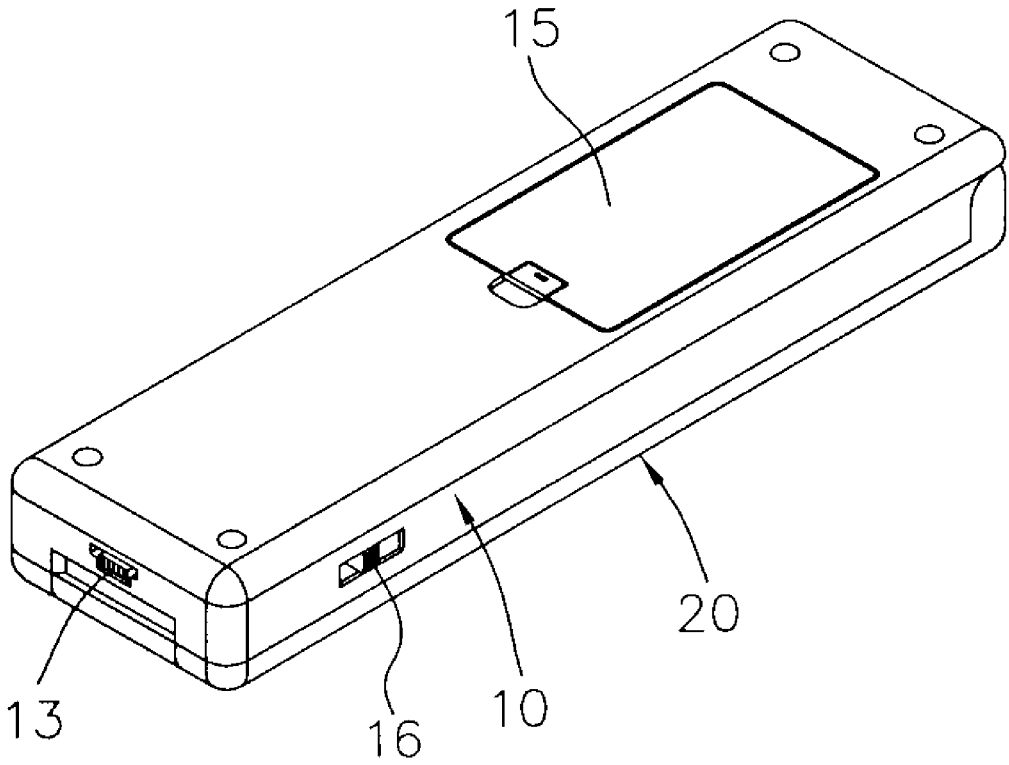
FIG. 2 shows the back of the portable illumination device that is folded into a compact body.

There are several ways of use of the present invention, as shown in FIGS. 1 and 2, the illumination unit 30 and the cover 20 are folded to the same plane and the first base 24 is accommodated in the hole of the board 31 and in flush with top surface of the board 31 so that the folded status of the present invention is a compact and concise rectangular body which is easily carried. As shown in FIG. 3, the light assembly 331 of the illumination unit 30, the third base 34 and the third pivot unit 35 are located in the first recess 11, and the pivot 261 is received in the second recess 111 when the cover 20 is closed on the base part 10. When using the portable illumination device 100, the switch 16 is operated to control the function of the light bulb 12 for temporary illumination need and the portable illumination device 100 is connected to the computer by the USB connector 13 so that the electric power is supplied by the computer.

As shown in FIGS. 3 and 4, when pivoting the cover 20 which is pivoted about the first pivot unit 22, and the pivot 261, the third base 34 and the third pivot unit 35 are removed from the second recess 111. The illumination unit 30 is disengaged from the first recess 11.

Figure 6:
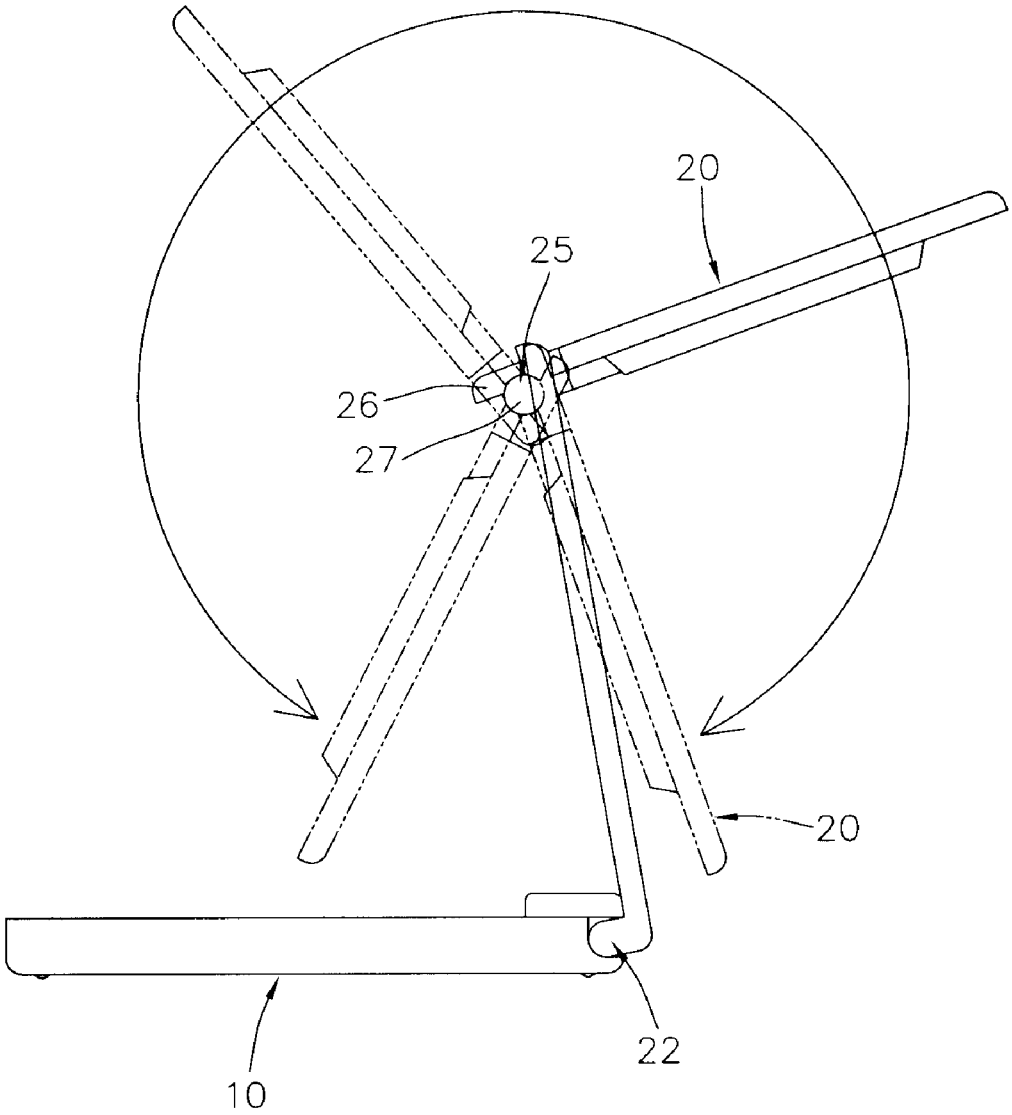
FIG. 6 is a side view to show that the illumination unit is pivotable relative to the cover.

As shown in FIGS. 5 and 6, holding the illumination unit 30 and pivoting the illumination unit 30 about the second pivot unit 25, the illumination member 33 is positioned at desired angle.

As shown in FIGS. 7 to 10, the illumination unit 30 can be independently adjusted by holding the board 31 and rotating the third pivot unit 35 about the third base 34, the third pivot unit 35, the illumination member 33 and the board 31 are pivoted relative to the support member 26 to adjust the position of the illumination member 33.

While we have shown and described the embodiment in accordance with the present invention, it should be clear to those skilled in the art that further embodiments may be made without departing from the scope of the present invention.

What is claimed is:

1. An illumination device comprising:

a rectangular base part having a switch connected to one side thereof and a first recess defined in a top of the base part, the base part having a first base at one end thereof and a light bulb connected to an end of the first base, two recessed areas defined the base part and the first base located between the two recessed areas, a battery reception hole defined in an underside of the base part;

a rectangular cover pivotably connected to the base part and having an opening, the cover having a first pivot unit on a first end thereof and pivotably connected to the first base so that the first pivot unit is pivotably located in the recessed areas and the cover is pivotable about the first base and relative to the base part, a second pivot unit connected to a second end of the cover and having a support member, a pivot and two second bases, the pivot connected to the support member and two ends of the pivot pivotably connected to the two second bases, the second pivot unit pivotable relative to the cover, a USB connector connected to a front end of the cover, and an illumination unit located within the opening of the cover and having an illumination member and a third pivot unit, the illumination member connected to a board which is sized to be accommodated in the opening and the illumination member being sized to be received in the first recess, the board pivotably connected to the third pivot unit which is rotatably connected to a third base which is fixed to the pivot of the second pivot unit, the board and the support member being located on the same surface and adjacent to each other when the cover is covered on the base part, the illumination unit being pivoted about the second pivot unit and positioned at different angles relative to the cover, the illumination unit being rotated about the third pivot unit so as to be position at different angles.

2. The device as claimed in claim 1, wherein the first recess is an elongate recess and a second recess is defined in the top of the base part and communicates with the first recess, the second recess is located close to the front end of the base part and perpendicular to the first recess, the pivot of the second pivot unit protrudes from the cover and is sized to be accommodated in the second recess, the third base and the third pivot unit are sized to be accommodated in the first recess.

3. The device as claimed in claim 1, wherein the two second bases protrude from the cover and are sized to be accommodated in the second recess.

4. The device as claimed in claim 1, wherein a light assembly is connected to the board.

5. The device as claimed in claim 1, wherein the first base protrudes from the base part and the board has a hole which is located corresponding to the first base so that when the cover is covered to the base part, the first base is located within the hole of the board.

* * * * *